United States Patent [19]

Gulla

[11] 4,085,066

[45] Apr. 18, 1978

[54] CATALYST COMPOSITION AND METHOD OF PREPARATION

[75] Inventor: Michael Gulla, Sherborn, Mass.

[73] Assignee: Shipley Company Inc., Newton, Mass.

[21] Appl. No.: 741,378

[22] Filed: Nov. 12, 1976

Related U.S. Application Data

[62] Division of Ser. No. 618,033, Sep. 30, 1975, Pat. No. 4,020,009.

[51] Int. Cl.[2] ..... B01J 27/08; B01J 27/10

[52] U.S. Cl. ..... 252/434; 252/438; 252/441; 106/1.11; 427/98; 427/304; 427/305; 427/306; 252/472; 252/473; 252/474; 252/475; 252/476

[58] Field of Search ..... 252/441, 438, 472, 473, 252/474, 475, 476, 434; 106/1; 427/98, 304, 305, 306

[56] References Cited

U.S. PATENT DOCUMENTS

| | | | |
|---|---|---|---|
| 3,011,920 | 12/1961 | Shipley | 427/98 |
| 3,672,923 | 6/1972 | Zeblisky | 106/1 X |
| 3,874,882 | 4/1975 | Gulla et al. | 106/1 |
| 3,904,792 | 9/1975 | Gulla et al. | 427/304 |

*Primary Examiner*—Patrick P. Garvin

*Attorney, Agent, or Firm*—Dike, Bronstein, Roberts, Cushman & Pfund

[57] ABSTRACT

This invention relates to dry colloidal catalyst compositions of catalytic metals and to methods for formation of said dry compositions. The dry catalysts, upon dispersion in an aqueous acid solution of pH below 1, are used to render surfaces receptive to the deposition of an electroless metal. The liquid catalyst compositions, from which the dry compositions are formed, are those acidic compositions of U.S. Pat. No. 3,011,920.

38 Claims, No Drawings

CATALYST COMPOSITION AND METHOD OF PREPARATION

This is a division, of application Ser. No. 618,033 filed Sept. 30, 1975 now U.S. Pat. No. 4,020,009.

BACKGROUND OF THE INVENTION

1. Introduction

This invention relates to electroless metal deposition and more particularly, to catalytic compositions useful therefor.

2. Description of the Prior Art

Electroless metal deposition refers to the chemical deposition of a metal on a conductive, non-conductive, or semi-conductive substrate in the absence of an external electric source.

Electroless deposition is used for many purposes, for example, in the manufacture of printed circuit boards where, in one method, an electroless metal, typically copper, is deposited on a dielectric substrate either as a uniform surface coating or in a predetermined pattern. This initial electroless deposit is usually thin and may be further built up by electroplating or may be deposited directly to full thickness.

The substrate over which an electroless metal deposit is formed is most often a plastic panel which may have a metal foil such as copper laminated to one or both of its surfaces, for example, with adhesive, to form a metal clad substrate. Where both surfaces of the substrate are to be used, connections are typically provided therebetween by means of holes through the panel at appropriate locations, the walls of these holes being made conductive with the electroless coating.

The electroless deposition of a metal on either a metallic or non-metallic substrate usually requires pretreatment or sensitization of the substrate to render it catalytic to the reception of such a deposit. Various methods have evolved over the years employing particular sensitizing compositions.

An early method of sensitization involves plural baths wherein a substrate is subjected first to immersion in an acidic stannous chloride solution and, following water rinsing, immersion in an acidic palladium chloride solution whereby the palladium chloride is reduced to a catalytic layer of palladium metal. This method has severe limitations because the palladium chloride solution, in contact with the copper layer of a copper clad substrate, forms an immersion deposit which is loosely adhered to the copper. This is wasteful of palladium and interferes with the bond between the copper cladding and a subsequently deposited electroless metal layer.

A major advance in the art of electroless metal deposition was achieved by the process of U.S. Pat. No. 3,011,920 incorporated herein by reference. According to said patent, a substrate was catalyzed by treatment with a liquid which contained a colloidal dispersion of a catalytic metal formed by the admixture of catalytic metal ions and stannous ions in an amount in excess of the catalytic metal ions in an acidic aqueous solution. By this method, the immersion coating formed by contact of palladium ions with copper cladding was eliminated as the catalytic metal is not in an ionic form, but rather, is in colloidal form, where the colloid is believed to be in an insolubilized reduced form of the catalytic metal. Other advantages were achieved with the invention of U.S. Pat. No. 3,011,920 such as decreased cost resulting from reduction in the number of steps in an overall plating process and reduction in the amount of catalytic metal consumed, improved coating, improved bond strength between coating and substrate, greater reliability and other improvements as enumerated in said patent.

For purposes of economy in shipping and storage, it is desirable to provide a catalyst in dry form which can be redispersed by simple admixture with an aqueous acidic solution. With reference to the catalyts of U.S. Pat. No. 3,011,920, it was believed that the catalysts thereof could not be dried and redispersed. This belief was due in part to stability tests where catalyst was left exposed in an open container with a large surface area, such as a petri dish. In these tests, it was found that with standing and evaporation of the liquid components of the catalyst, the catalyst would coagulate prior to complete drying and once coagulated, could not be redispersed.

In the prior art, one attempt at production of a dry catalyst material is reported in U.S. Pat. No. 3,672,923. The catalyst of said patent, prior to drying, is reported to be made by the admixture of catalytic metal ions and a reducing agent therefor such as stannous ions in an aqueous acidic medium under specific conditions such that, rather than forming a colloidal catalyst as in U.S. Pat. No. 3,011,920, a complex optically clear non-colloidal "true solution" catalyst of unreduced catalytic metal ions is formed. It is reported that because this catalyst is a true solution complex, it can be dried to powder form whereas a colloidal catalyst could not be similarly dried. A typical reported method for making a complex catalyst, as opposed to a colloidal catalyst, and drying the same is set forth in Example 3 of the patent wherein stannous chloride is dissolved in 37% hydrochloric acid, diluted and admixed with palladium chloride. The mixture is heated to 85° C for 20 minutes, then boiled for 1.5 hours, cooled and vacuum evaporated to dryness. It is reported that this procedure forms a true solution complex catalyst.

SUMMARY OF THE INVENTION

The present invention provides dry catalyst compositions believed to be of reduced catalytic metals and method for formation of said dry catalysts. The dry catalysts, upon dispersion in an aqueous acidic solution of pH below about 1 have substantially the composition of the acidic catalysts of U.S. Pat. No. 3,011,920.

The invention herein is based upon the discovery that, during manufacture, dry colloidal catalysts lose their excess stannous ion by aerial oxidation and can be redispersed in a liquid hydrohalide acid solution only if the dry product contains excess stannous ions. Thus, in accordance with the invention, the dry catalyst may be made either from the liquid catalyst compositions of said U.S. Pat. No. 3,011,920, using methods that avoid aerial oxidation or by replenishing dry catalyst compositions that have undergone aerial oxidation with an additional stannous salt, or said dry catalyst composition may be made directly from the solid components of the catalyst in dry form.

DESCRIPTION OF THE PREFERRED EMBODIMENTS

In accordance with this invention, the term "dry catalyst" means a solid material that may be completely dry, but preferably contains a moisture content of from 2 to 25% and more preferably, a moisture content of from 5–15%, by weight. This retained moisture is preferred as it permits the dry material to be dispersed in liquid suspension with greater ease.

In one embodiment of this invention, dry catalyst is prepared from a liquid colloidal catalyst composition of the reduced noble metal disclosed in U.S. Pat. No. 3,011,920. The liquid catalysts are formed by the admixture of a catalytic metal salt and a stannous salt in excess of the catalytic metal salt in an acid medium having a pH below 1. For purposes of this invention, the preferred colloidal catalyst solution is the palladium catalyst described in Example 2 of said patent. In general, the compositions and method for making and using said liquid catalysts are fully disclosed in said patent and further discussion herein is deemed unnecessary. However, it should be noted that the catalysts of said patent are colloidal and thus, are already in a solid particulate form as compared to the compositions reported in U.S. Pat. No. 3,672,923. As a consequence, upon drying the catalyst to make the dry catalyst of this invention, there is no change in the physical state of the catalytic material-i.e., the catalytic material is not converted from a solution species to a solid species as is necessary in the aforesaid U.S. Pat. No. 3,672,923.

The catalyst compositions of U.S. Pat. No. 3,011,920 are preferably dried under conditions whereby aerial oxidation of excess stannous ions is substantially avoided. This can be conveniently accomplished by drying the catalyst under vacuum or in an inert atmosphere, preferably at slightly elevated temperatures, e.g., at temperatures ranging between about 90° F and 150° F, though temperatures up to the boiling point of the catalyst composition may be used if care is exercised to prevent over-drying. If it is desired to avoid elevated temperatures, the liquid catalyst can be freeze dried under vacuum. During drying, hydrohalide acid is evolved which causes the excess stannous ion to dry to stannous halide and hydrolized products of the stannous ion. The colloid is believed to retain its original reduced form and its protective colloid of stannic acid.

If substantial aerial oxidation of excess stannous ions during drying cannot be avoided, the catalyst will contain a substantial concentration of tin, but the tin will be in the stannic rather than the necessary stannous form. However, the catalyst can still be dried with oxidation of stannous and then replenished with a dry stannous salt, preferably a stannous halide, and most preferably stannous chloride. Replenishment is preferably accomplished in the dry state by blending the dry catalyst product with the stannous salt. Alternatively, replenishment with stannous ion can be achieved by redispersing the dried catalyst product, substantially free of excess stannous salt, in an aqueous acid solution containing the dissolved stannous salt. Whether replenishment is accomplished in the dry state or by redispersing the dried catalyst in a liquid medium, the final concentration of the excess stannous should be sufficient to provide a ratio of excess stannous to the catalytic metal of at least 2 to 1, preferably at least 5 to 1, and more preferably, between 10 to 1 and 50 to 1.

In another embodiment of the invention, a dry catalyst product is formed by admixture of a dry salt of the catalytic metal with a dry stannous salt, the stannous salt being in a concentration such that ratio of stannous to catlytic metal is at least 2 to 1. The salts are wetted with a concentrated hydrohalide acid in an amount sufficient to dampen the dry mixture, but not dissolve the dry powders to any appreciable extent. Typically, one milliliter of acid per gram of solids is adequate though this ratio can vary considerably, for example, between about 0.1 ml per gram to 5 ml per gram or more. The mixture is triturated until a homogeneous blend is achieved. It is of interest that the triturate exhibits the color change typically exhibited during the preparation of the liquid catalyst compositions of U.S. Pat. No. 3,011,920. Preferably, following color change to dark brown, the powder mixture is dried in conventional manner. If dried prior to color change, the powder mixture, upon redispersion, will not provide a catalyst that is immediately fully functional, but rather one that becomes fully functional with standing.

The aforesaid method for making a dry catalyst composition provides several advantages. For example, the cost associated with evaporation of large volumes of liquid are avoided. Also, since the liquid catalyst compositions have a pH well below 1, they are exceedingly corrosive and consequently, special equipment is necessary for drying the same. The admixture of dry powders, as described above, avoids the need for this costly process equipment. Additionally, since large volumes of liquid need not be evaporated from the catalyst during the drying process, there is less opportunity for loss of stannous by aerial oxidation.

The aforesaid process also suffers one disadvantage. The dry powder, upon redispersion in an aqueous acid medium, may not be immediately fully functional, but rather, may have to age for some period of time. For reasons not fully understood, the aging period for this dry catalyst blend following dispersion is somewhat unpredictable and can vary from as little as a few minutes up to several days.

The most preferred method for making a dry catalyst blend in accordance with this invention comprises coagulation of the colloidal catalyst of U.S. Pat. No. 3,011,920 by the addition of a suitable base. Above pH 1, the catalyst components begin to coagulate and drop out of solution. At pH 3 and above, all catalyst components will drop out of solution, the colloid by coagulation and the excess stannous by precipitation in a form believed to be a hydrolysis product, though some stannous halide will also precipitate. As the pH is increased further, the rate of coagulation and precipitation is accelerated, though at pH above 8.0, the catalyst components go into solution. Thus, a preferred range of pH is from 3 to 8. Suitable bases for effecting neutralization comprise alkali metal, alkaline earth metal and ammonium hydroxides, carbonates, bicarbonates and other materials as would be obvious to one skilled in the art that do not destroy the colloidal catalytic particles. The dry catalyst will also contain the products of neutralization such as alkali, alkaline earth metal or ammonium halides.

The addition of base to the acidic liquid colloidal catalyst causes an exothermic reaction. Care must be taken since high temperatures during this stage of the process, e.g., about 140° F or 150° F or higher, adversely affect the redispersibility of the colloidal catalyst, at least temporarily. The rate of addition of the alkaline material is preferably controlled so that the temperature of the liquid mixture is not allowed to go over about 120° F, preferably not over 90° F.

The colloidal catalyst of the present invention which is formed by the above alkaline precipitation process may or may not have the same or similar chemical composition or physical structure as that of the colloidal catalyst which is in the liquid mixture prior to precipitation. Obviously, some change occurs since the precipitated colloidal material can no longer be held dispersed by the liquid. It may be that some or all of the salts hydrolyze to some degree or undergo some other reaction as the pH is raised. At any rate, upon redispersion of the dried colloidal catalyst, it essentially immediately behaves in the same manner as the colloidal catalyst of the aforesaid U.S. Pat. No. 3,011,920, i.e., in the same manner as it would have if it had never been subjected to the precipitation and drying steps of the present invention. Without desiring to be bound by any particular theory as to how the present invention works, it is quite apparent that the reactions that take place to form the precipitate are pH dependent and easily reversible.

After the colloidal catalyst has been precipitated, it is separated from the supernatant liquid. This may be accomplished by simple decantation, by centrifugation, by filtration or by other means known in the art. Once separated from the supernatant liquid, the precipitate will still be wet, and will need to be dried. This too may be accomplished by many ways previously known in the art. Air drying, with or without heat, oven drying, and vacuum evaporation are but some of the available techniques. Following this procedure, it is particularly desirable in this method not to allow the material to become too hot or excessively dehydrated. Its ability to be fully redispersed can be adversely affected if it is allowed to reach a temperature substantially above 140°-150° F, if it is dried too quickly or if the material is overdried. About 2 to 25%, preferably 5-15% by weight moisture should be left in the substantially solid material. It is easily determined if the material is being dried too quickly or overdried, by stirring a small sample in 4 N HCl and observing whether the sample is fully dispersed. The preferred method of drying the precipitate is by vacuum evaporation with the material being heated slightly. This technique results in a dried material in a minimal time, and the vacuum prevents air oxidation of the stannous ions.

The dried colloidal catalysts obtained by the aforesaid methods are quickly repeptized by aqueous acidic solutions, and are essentially immediately active to catalyze conductive, nonconductive, or semiconductive surfaces. Acids which are suitable for use in the original formation of the liquid are also suitable for repeptizing the solid colloidal catalyst of the present invention, the hydrohalic acids, particularly hydrochloric and hydrobromic being preferred. The solid colloidal catalyst need not be repeptized to give the same liquid concentrations of components as was present in the liquid from which it was made. Rather, a wide range of functional liquids can be made using the solid colloid at various concentrations in the peptizing liquid. Generally, sufficient solid colloidal catalyst should be used per liter of peptizing liquid to give from about 0.0001 to 0.3 moles per liter of the catalyzing metal, preferably from 0.0005 to 0.05 moles per liter.

The dry catalyst formulations of this invention contain excess stannous in the form of a stannous salt and consequently, are hydroscopic. Therefore, if the dry catalyst is to be stored for any length of time, it should be stored so as to avoid contamination by absorbed water vapor such as by addition of a dessicant, e.g., magnesium chloride, to the package.

The following examples will better illustrate the invention. In the examples that follow, examples 1 to 5 illustrate typical liquid catalyst formulations that may be dried in accordance with the subject invention.

| | | |
|---|---|---|
| Example 1 | | |
| $PdCl_2$ | 1 | g |
| Water | 600 | ml |
| HCl(conc) | 300 | ml |
| $SnCl_2$ | 50 | g |
| Example 2 | | |
| $PdCl_2$ | 1 | g |
| Water | 600 | ml |
| HCl(conc) | 300 | ml |
| Sodium Stannate | ($Na_2SnO_3 \cdot 3H_2O$) | |
| | 1½ | g |
| $SnCl_2$ | 37½ | g |
| Example 3 | | |
| $HAuCl_4 \cdot H_2O$ | 1 | g |
| Water | 600 | ml |
| HCl(conc) | 300 | ml |
| Sodium Stannate | (optional) | |
| | 1½ | g |
| $SnCl_2$ | 37½ | g |
| Example 4 | | |
| $H_2PtCl_6$ | 1 | g |
| Water | 600 | ml |
| HCl(conc) | 300 | ml |
| Sodium Stannate | (optional) | |
| | 1½ | g |
| $SnCl_2$ | 37½ | g |
| Example 5 | | |
| Rhodium Chloride | 1 | g |
| Water | 600 | ml |
| HCl(conc) | 300 | ml |
| $SnCl_2$ | 50 | g |

In the above examples, the ingredients are preferably added in the order listed. The reduced colloidal catalyst is formed by the reduction of catalytic metal ions by the stannous chloride. It is believed that simultaneously, stannic acid colloids are formed, together with absorbed stannic oxy chloride and stannic chloride. The stannic acid colloids comprise protective colloids for the catalytic metal colloids while the oxy chloride is believed to constitute a deflocculating agent further promoting the stability of the colloidal solution. The relative amounts of the ingredients can be varied provided the pH is maintained below about 1 and provided an excess of stannous ions is maintained. The solution can also be made more concentrated for ease of drying though as the concentration of ingredients increases, greater precautions must be exercised to prevent the premature aging and flocculation of the catalyst.

EXAMPLE 6

Using the catalyst formulation of Example 2, 50 ml of said solution were added to a petri dish having a height of ½ inch and a diameter of 5 inches. The catalyst was allowed to stand in the petri dish open to air for about one week, a time sufficient for all liquid components of the catalyst to evaporate. At the end of the week, a dry frangible film could be scraped from the bottom of the petri dish. This material was ground to a fine powder using a mortar and pestle and then subdivided into three equal portions, each weighing approximately 1¾ grams. Three separate solutions were then prepared, each containing 15 ml of concentrated hydrochloric acid and 30 ml of water in a 50 ml beaker. These solutions were labeled solution 1, 2 and 3 respectively. Two grams of stannous chloride were dissolved in solution 3. The first portion of the dried and ground catalyst was added to solution 1 and stirred. Following stirring, after about three miunutes, a black precipitate could be observed on the bottom of the beaker containing solution 1. After about 10 minutes, most of the solid material collected on the bottom of the beaker leaving a brackish appearing supernatent liquid above the precipitate containing some suspended material.

The second portion of the dried and ground catalyst was mixed with 2 grams of stannous chloride powder and added to solution 2. A dark brown composition was obtained that was stable for more than 24 hours. No precipitate could be observed on the bottom of the beaker containing solution 2.

The third portion of the dried and ground catalyst was added to solution 3. A dark brown solution was formed that, like the catalyst formed in solution 2, was stable for a period of in excess of 24 hours.

Each of the aforesaid solutions was tested for catalytic activity by immersing a prepared phenolic plaque in each of the catalytic solutions for a period of five minutes. Following catalysis, each plaque was immersed in a mild acid accelerator and then in a standard electroless copper plating solution for ten minutes. Limited copper deposit was detectable on the plaque immersed in the solution 1. Excellent copper deposition was achieved with the catalysts of solutions 2 and 3. It is believed that some stannous was left in the original dried sample, but the amount was limited such that the material was commercially unsuitable.

EXAMPLE 7

The procedure of Example 6 is repeated substituting the catalyst of Example 4 for the catalyst of Example 2 with similar results.

EXAMPLE 8

An Erlenmeyer flask was charged with 200 ml of the catalyst of Example 2. The flask was equipped with a condenser and connected to a vacuum pump to create a vacuum over the catalyst. The catalyst was heated to 150° F and dried to solid dry film over a period of several hours. The dry film of catalyst was scraped from the bottom of the flask and ground to a fine powder using a mortar and pestle. A solution was prepared comprising 60 ml of concentrated hydrochloric acid and 120 ml of water. The dried and ground catalyst was added to the solution to form a dark brown solution stable for a period of in excess of 24 hours. Following the procedure set forth above in Example 6, the catalyst solution was found to possess full catalytic activity.

EXAMPLE 9

The procedure of Example 8 was repeated substituting a nitrogen atmosphere for the vacuum of Example 8. The drying period was increased to 6 hours. Again, a fully functional catalyst solution was obtained following redispersion.

EXAMPLE 10

The procedure of Example 8 was repeated using the catalyst formulation of Example 2, but substituting platinum chloride for palladium chloride. Similar results were obtained.

EXAMPLE 11

A mixture of 0.1 grams of palladium chloride and 4 grams of stannous chloride was dampened with 5 ml of concentrated hydrochloric acid and ground together with a mortar and pestle. The mixture of powders was then permitted to stand for one hour during which period of time, the powders changed from green to dark brown. The mixture was then heated to about 120° F to drive off the hydrochloric acid and reground to a fine powder.

A solution was prepared comprising 35 ml of concentrated hydrochloric acid and 65 ml of water. The dry powder was added to the solution with stirring to form a dark brown solution stable for a period in excess of 24 hours. The catalytic activity of this solution was tested immediately after preparing the solution, one hour after preparing the solution, and 24 hours after preparing the solution, each test following the procedure of Example 6. In each case, catalytic activity was observed though the copper coverage over the phenolic plaque catalyzed immediately after preparing the solution was only fair, after one hour was substantially improved, and after 24 hours, full catalytic activity was obtained.

EXAMPLE 12

Using the catalyst formulation of Example 1, 200 ml of said catalyst was neutralized by the addition of sodium hydroxide until a pH of 7 was achieved. At this pH, a black precipitate was observed on the bottom of the container containing said catalyst and the supernatant liquid over said precipitate was water-white and clear. The liquid was decanted and the precipitate collected and dried by infra-red heating. The precipitate was then ground using a mortar and pestle. A solution was prepared comprising 60 ml of concentrated hydrochloric acid and 130 ml of water. The precipitate was redispersed in the solution and catalytic activity was determined by the procedures of Example 6 above. The catalyst was found to be fully functional and was stable for in excess of 24 hours.

EXAMPLE 13

The procedure of Example 12 was repeated with the catalyst of Example 4 with substantially the same results.

EXAMPLE 14

Using the catalyst of Example 2, 5 mls were placed in an ultracentrifuge tube which was stoppered and spun in an ultracentrifuge for 24 hours at 25,000 RPM using a 6 inch rotor. A brown-black residue was obtained on the bottom of the tube. The liquid above this residue was water-white and free of palladium. This confirms the colloidal nature of the catalyst of Example 2.

The supernatant liquid above the residue was decanted and the residue removed. This was dried using infra-red heating to yield a frangible mass that was readily ground to a fine powder.

A solution was prepared containing 5 ml of concentrated hydrochloric acid and 15 ml of water. The dry catalyst powder was stirred into the solution to yield a stable, functional catalyst composition.

The dry catalysts of this invention have a formulation dependent upon the manner in which they are produced though all are believed to have common components. For example, all contain the catalytic metal in a colloidal reduced form as the colloidal material is formed by the reduction of the catalytic metal by stannous tin to yield the reduced colloidal catalyst and stannic tin as well as what is believed to be a stannic acid protective colloid. All contain tin compounds in some form, a portion of which is stannic tin formed by the reduction of the catalytic metal. Finally, all possess a total tin content such that the tin to catalytic metal molar ratio is at least 2:1.

The balance of the dry catalyst composition is dependent upon the manner in which it is formed.

If the liquid catalysts of U.S. Pat. No. 3,011,920 are dried taking precaution to avoid substantial aerial oxidation of stannous tin, then the dry composition will contain, in addition to the above common components, stannous halide as well as some hydrolysis products of stannous halide. If stannous tin is oxidized during drying, then instead of stannous halide and its hydrolysis products, the dry product will have a substantially and correspondingly greater concentration of stannic tin. Stannous halide may be added to such a dry composition as described above.

If the dry catalysts are formed by neutralization rather than drying as described above, then the dry composition will contain, in addition to the aforesaid common components, the salts formed as a result of the neutralization reaction—e.g., sodium chloride if the catalyst is neutralized with sodium hydroxide. In addition, the dry composition will contain stannous halide and hydrolysis products thereof.

Finally, if the dry composition is formed by blending dry powders, then the dry composition will contain, in addition to the common components, a larger concentration of stannous halide, but should be substantially free of hydrolysis products of stannous halide.

In addition to the uses of the dry catalyst claimed herein, other uses are possible, For example, the dry material can be incorporated into a plastic substrate by blending the dry material with powders of the plastic before fabricating the plastic sheet. For example, from 0.1 to 5% by weight of the dry catalyst can be blended with plastic powders, e.g., powders of ABS and molded to shape to provide a plateable ABS substrate. Alternatively, the catalyst powders may be blended with a solvent and impregnated into the surface of a plastic sheet or in an adhesive and adhered to the surface. In each embodiment, a catalytic surface is provided.

I claim:

1. A process for the formation of an essentially dry composition which, upon admixture with an aqueous hydrohalide acid solution having a pH less than 1, forms a stable colloidal catalyst solution for catalyzing a substrate prior to deposition of an electroless metal, said process comprising mixing powders of a catalytic metal halide with a stannous halide, said powders having been dampened with a hydrohalide acid, the molar ratio of the stannous content of the stannous halide to the catalytic metal content of the catalytic metal halide being at least 2:1, and permitting said mixture to stand until a color change occurs.

2. The process of claim 1 where the ratio of the stannous to the catalytic metal is at least 5:1.

3. The process of claim 2 where the ratio varies between 10:1 and 50:1.

4. The process of claim 2 wherein the mixture is dampened with hydrohalide acid in an amount of at least 0.1 ml of acid per gram of powder.

5. The process of claim 2 where the catalytic metal halide is a halide of a member selected from the group of silver, gold, and the platinum family of metal halides.

6. The process of claim 5 where all of said halides are chlorides.

7. The process of claim 6 where said catalytic metal is palladium.

8. The product formed by the process of claim 1.

9. The product formed by the process of claim 7.

10. A process for making a catalyst composition for catalyzing a substrate prior to electroless metal deposition, said process comprising dispersing the product of claim 40 in an acid solution having a pH less than about 1.

11. A process for making a catalyst composition for catalyzing a substrate prior to electroless metal deposition, said process comprising dispersing the product of claim 9 in a hydrochloric acid solution having a pH less than about 1.

12. A process for the formation of an essentially dry composition which, upon admixture with an aqueous hydrohalide acid solution having a pH less than 1, forms a stable colloidal catalyst solution for catalyzing a substrate prior to the deposition of an electroless metal, said process comprising the steps of providing a liquid catalyst solution that is the colloidal product resulting from admixture in hydrohalide acid of a catalytic metal halide with a stannous halide, the molar ratio of the stannous halide to the catalytic metal halide being at least 2 to 1 and said liquid catalyst composition having a pH less than 1; increasing the pH of said liquid catalyst solution to in excess of 1 to precipitate and coagulate solids from said liquid catalyst composition while maintaining the temperature of the solution below about 140° F; separating the solids from the liquid of said liquid catalyst composition; and slowly drying said solids at a temperature below about 140° F under conditions whereby oxidation of the stannous ions of the stannous halide is avoided for a time sufficient to provide a dry catalyst product having a moisture content of from 2 to 25% by weight.

13. The process of claim 12 where the ratio of the stannous of said stannous halide to the catalytic metal of said catalytic metal halide is at least 5:1.

14. The process of claim 13 where the ratio varies between 10:1 and 50:1.

15. The process of claim 13 where the pH of the catalyst solution is increased to in excess of 3.

16. The process of claim 15 where the pH is increased to about 7.

17. The process of claim 15 where the catalytic metal halide is a halide of a member selected from the group of silver, gold, and the platinum family of metals.

18. The process of claim 15 where the pH is increased by the addition of a member selected from the group consisting of alkali metal, alkaline earth metal and ammonium hydroxides, carbonates and bicarbonates.

19. The process of claim 18 where the pH is raised by the addition of sodium hydroxide.

20. The process of claim 15 where all of said halides are chlorides.

21. The process of claim 20 where the catalytic metal is palladium.

22. The product formed by the process of claim 17.

23. The product formed by the process of claim 21.

24. A process for making a catalyst composition for catalyzing a substrate prior to electroless metal deposition, said process comprising dispersing the product of claim 22 in a hydrohalide acid solution having a pH less than about 1.

25. A process for making a catalyst composition for catalyzing a substrate prior to electroless metal deposition, said process comprising dispersing the product of claim 23 in a hydrochloric acid solution having a pH less than about 1.

26. A process for the formation of an essentially dry composition which, upon admixture with an aqueous hydrohalide acid solution having a pH less than 1, forms a stable colloidal catalyst solution for catalyzing a substrate prior to deposition of an electroless metal, said process comprising the steps of poviding a liquid catalyst solution that is the colloidal product resulting from the admixture in hydrohalide acid of a catalytic metal halide with a stannous halide, the molar ratio of the stannous halide to the catalytic metal halide being at least 2 to 1, said liquid catalyst composition having a pH less than 1; and drying said catalyst composition under conditions whereby substantial oxidation of stannous ions from said stannous salt is avoided.

27. The process of claim 26 where said liquid catalyst solution is vacuum dried.

28. The process of claim 26 where said liquid catalyst solution is dried in an inert atmosphere.

29. The process of claim 26 where said liquid catalyst solution is freeze dried.

30. The process of claim 26 where the ratio of the stannous ions from said stannous salt to the catalytic metal ions from the catalytic metal salt is at least 5:1

31. The process of claim 30 where the ratio varies between 10:1 and 50:1.

32. The process of claim 30 where the catalytic metal halide is a halide of a member selected from the group of silver, gold, and the platinum family of metal halides.

33. The process of claim 32 where all of said halides are chlorides.

34. The process of claim 33 where said catalytic metal is palladium.

35. The product formed by the process of claim 31.

36. The product formed by the process of claim 34.

37. A process for making a catalyst composition for catalyzing a substrate prior to electroless metal deposition, said process comprising dispersing the product of claim 35 in a hydrohalide acid solution having a pH less than about 1.

38. A process for making a catalyst composition for catalyzing a substrate prior to electroless metal deposition, said process comprising dispersing the product of claim 36 in a hydrochloric acid solution having a pH less than about 1.

* * * * *